US005896087A

United States Patent [19]

Frowein

[11] Patent Number: 5,896,087

[45] Date of Patent: Apr. 20, 1999

[54] THEFT PROTECTION SYSTEM, PARTICULARLY FOR TEXTILES, LEATHER GOODS AND OTHER PRODUCTS

[75] Inventor: Bernhard Frowein, Schlangen, Germany

[73] Assignee: Friedrich Graf Söhne GmbH & Co. KG, Schlangen, Germany

[21] Appl. No.: 08/904,037

[22] Filed: Jul. 31, 1997

[30] Foreign Application Priority Data

Aug. 2, 1996 [DE] Germany ..... 196 31 297

[51] Int. Cl.[6] ..... G08B 13/14

[52] U.S. Cl. ..... 340/572; 455/100

[58] Field of Search ..... 340/572, 573; 361/765; 342/44, 27–28; 29/592.1, 25.42; 455/100

[56] References Cited

U.S. PATENT DOCUMENTS

| | | | |
|---|---|---|---|
| 4,626,311 | 12/1986 | Taylor | 340/572 |
| 4,650,219 | 3/1987 | Sigman | 283/70 |
| 4,875,238 | 10/1989 | Solomon et al. | 2/115 |
| 5,047,750 | 9/1991 | Hector | 340/573 |
| 5,079,541 | 1/1992 | Moody | 340/573 |
| 5,172,461 | 12/1992 | Pichl | 29/25.42 |
| 5,357,660 | 10/1994 | Smith | 24/662 |
| 5,508,684 | 4/1996 | Becker | 340/572 |
| 5,583,489 | 12/1996 | Loemker et al. | 340/572 |

FOREIGN PATENT DOCUMENTS 9308632 12/1994 Germany .

*Primary Examiner*—Nina Tong
*Attorney, Agent, or Firm*—Friedrich Kueffner

[57] ABSTRACT

A theft protection system, particularly for textiles, leather goods and other products, wherein the products are provided with a function strip, such as a seam band, waste band, hanger, label or the like, and wherein the function strip is provided with an alarm tripping device. The theft protection system further includes at least one detector placed in the exit areas of the selling floor of a shop, department store of the like, wherein the detector responds when a products provided with the alarm tripping device is being moved past the detector. The alarm tripping device includes at least one linear alarm tripping component provided for detectability and mounted on a carrier. The linear alarm tripping component of the alarm tripping device is connected to the carrier in the manner of a thread by a textile manufacturing method.

12 Claims, 2 Drawing Sheets

FIG. 1
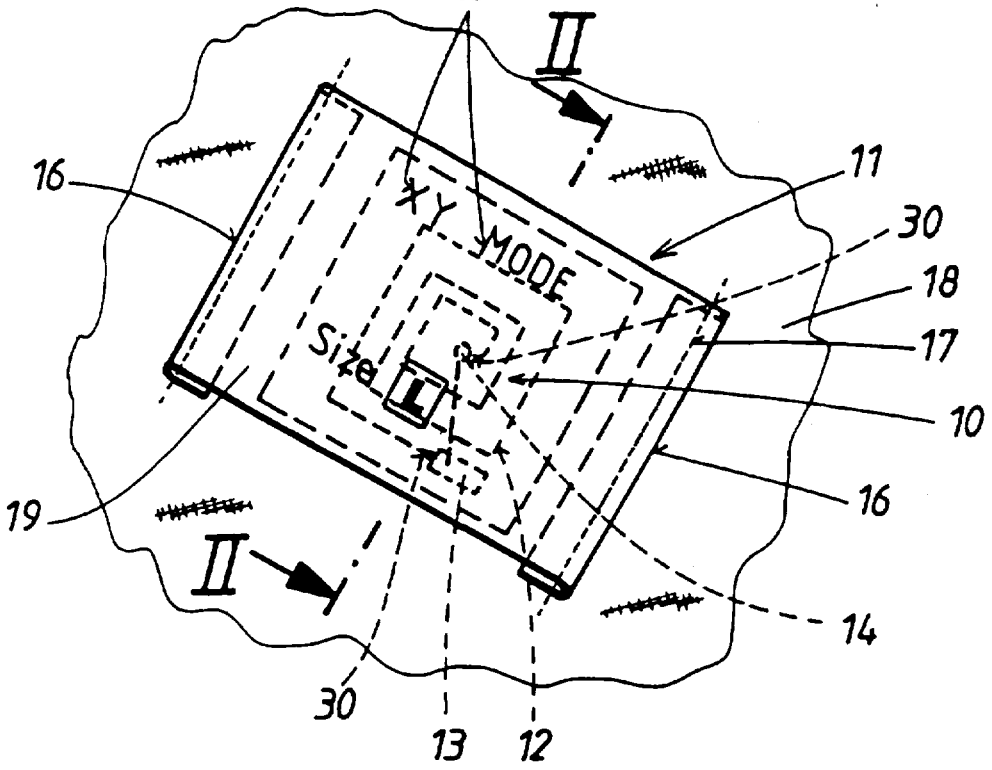
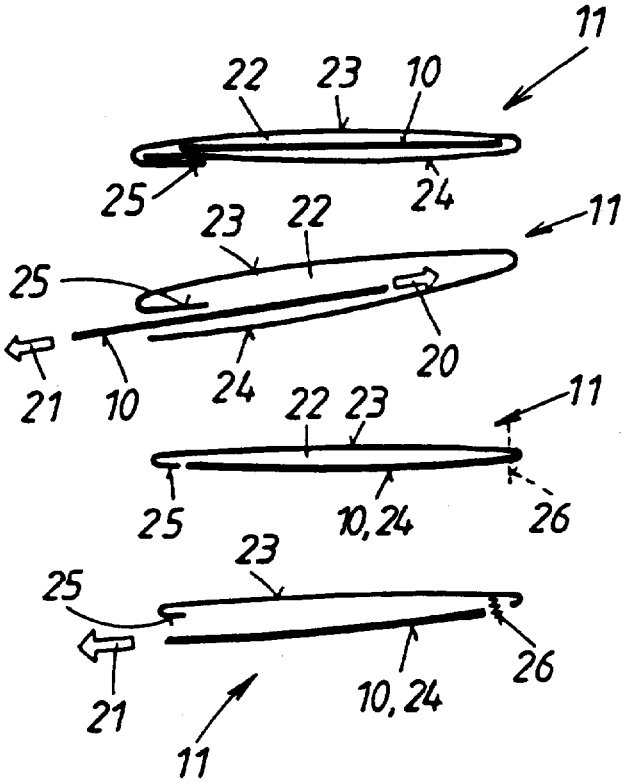
FIG. 2
FIG. 3
FIG. 4
FIG. 5

FIG. 6
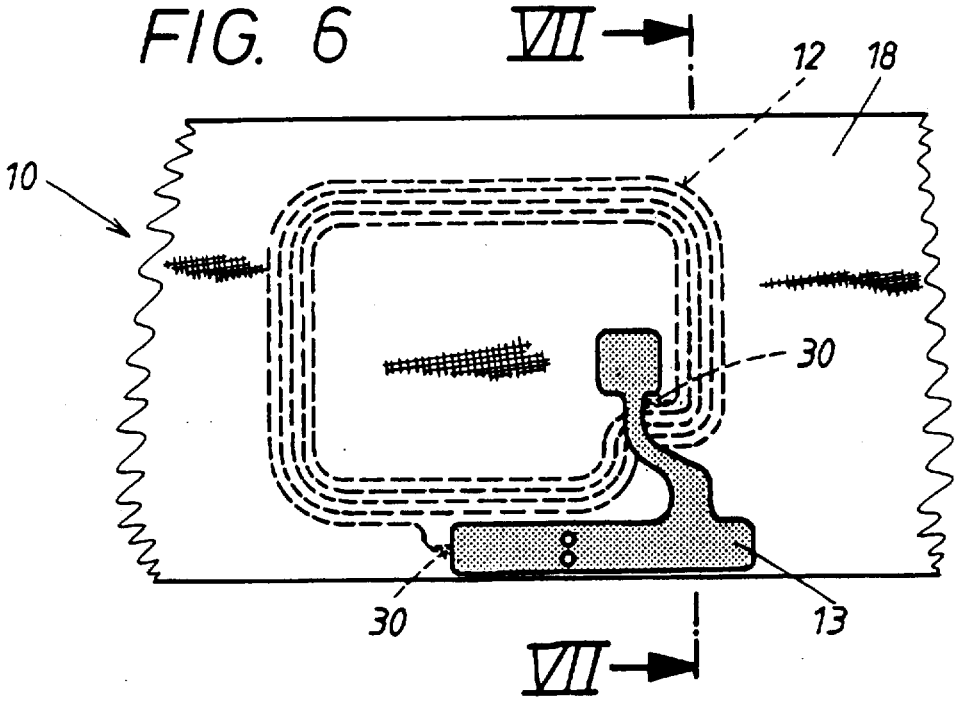
FIG. 7
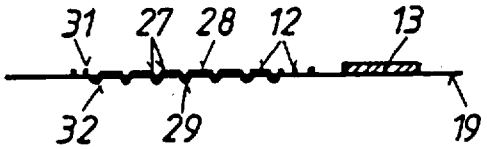
FIG. 8
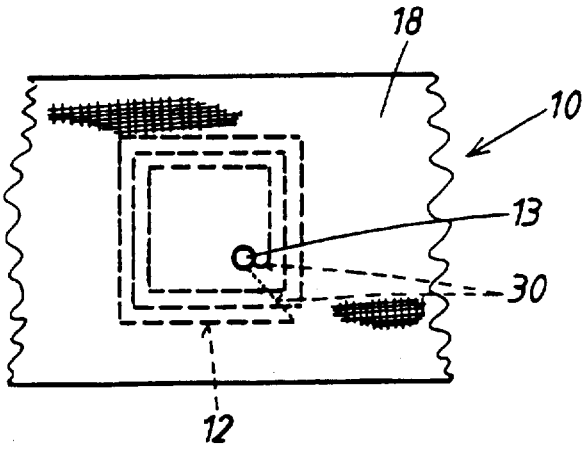
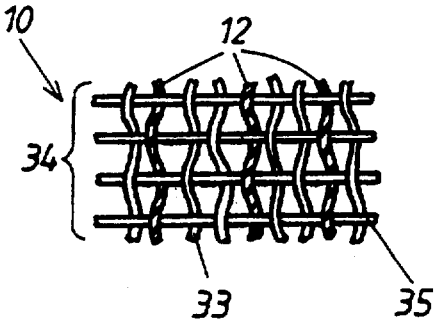
FIG. 9

THEFT PROTECTION SYSTEM, PARTICULARLY FOR TEXTILES, LEATHER GOODS AND OTHER PRODUCTS

BACKGROUND OF THE INVENTION

1. Field of the Invention

The present invention relates to a theft protection system, particularly for textiles, leather goods and other products, wherein the products are provided with a function strip, such as a seam band, waste band, hanger, label or the like, and wherein the function strip is provided with an alarm tripping device. The theft protection system further includes at least one detector placed in the exit areas of the selling floor of a shop, department store of the like, wherein the detector responds when a products provided with the alarm tripping device is being moved past the detector. The alarm tripping device includes at least one linear alarm tripping component provided for detectability and mounted on a carrier.

2. Description of the Related Art

In theft protection systems of the above-described type, an alarm tripping device, such as a transponder or a magnetic strip, is attached to a product. When a product secured in this manner is moved past a detector and the alarm tripping device has not been previously removed or made inoperative, the detector triggers an alarm. In alarm tripping devices of the above-mentioned type it is known in the art to mount the alarm tripping device, for example, a transponder, in a rigid plastic badge which is mounted visibly and detectably on a product, for example, on an article of clothing. In the transponder, a thread-shaped alarm tripping component, such as a coil of metal wire is connected to a capacitor to form an oscillation circuit. This oscillation circuit becomes active when an electromagnetic field acts from outside through the detector on the circuit and a current flow is produced inductively in the coil. In this manner, the alarm tripping device, in turn, produces an electromagnetic field which is sensed by the detector and the alarm is triggered as a result.

In a second type of alarm tripping devices, the thread-shaped alarm tripping component is mounted in the form of a magnetizable or a permanently magnetic strip onto an adhesive paper label. In the case of the embodiment using the magnetizable magnetic strip, the alarm tripping device must be magnetized prior to the sale of the product and the alarm tripping device is demagnetized once the product is sold.

Both alarm tripping devices of this type have in common that the weak magnetic field emanating from such a strip is sensed by a detector placed in an exit area when the product secured by such a label is moved past the detector and the detector then triggers an alarm.

It is known from German utility model G 9308632.6 to integrate an alarm tripping device, such as a transponder, in a function strip for textile products, wherein the alarm protection can then be removed again by an authorized person. Such a function strip may be, for example, the waist band of trousers, a hanger of a jacket or a label, etc. The function strip is sewn to the product, a piece of material of the article of clothing or the like, and the function strip cannot be removed without major effort. The function strip is constructed in two layers, wherein a free space, such as a pocket, exists between the two layers, wherein the alarm tripping device is placed in the free space.

The alarm tripping devices constructed as plastic badges can be seen very easily because of their configuration and size and, therefore, they can be easily identified and rendered useless by a potential burglar. In addition, the production cost of these alarm tripping devices is relatively high because of the number of necessary production steps.

The alarm tripping devices integrated in a function strip are also more difficult to produce because they require a separate manufacture of the alarm tripping device which is only subsequently integrated in the function strip.

SUMMARY OF THE INVENTION

Therefore, it is the primary object of the present invention to develop a theft protection device of the above-described type which is inexpensive to manufacture and facilitates a secure utilization in the above-described field of use.

In accordance with the present invention, the linear alarm tripping component of the alarm tripping device is connected to the carrier in the manner of a thread by a textile manufacturing method.

The thread-like alarm tripping component may be subsequently stitched in the form of a stitching yarn onto the function strip, or the thread-like alarm tripping component is simultaneously woven into the function strip, for example, as a warp thread, simultaneously with the manufacture of the function strip.

The use of the textile method provides the advantage that a very secure connection is obtained between the thread-like alarm tripping component and the carrier, wherein the carrier may also be a layer of a function strip. The manufacturing method according to the present invention makes it possible that the alarm tripping unit may not be seen easily, so that a possible burglar will have difficulty detecting and removing the alarm tripping device.

Another advantage is the fact that the carrier can be made of various materials, such as non-woven fabric, foil, woven or knitted fabric, so that the alarm tripping device can be used universally.

When operating as a transponder or the like in which the thread-like alarm tripping component is arranged as a coil, the thread-like alarm tripping component is composed of an electrically highly conductive metal, such as copper, which then advantageously interacts with other electronic components of a circuit. It is further useful in this connection if the other electronic components have special contact lugs which make possible an electric contact of the thread-like alarm tripping component with the other electric components by merely moving them toward each other.

In accordance with another embodiment of the present invention, the thread-like alarm tripping component includes a magnetizable material which is worked together with the thread-like alarm tripping component into the carrier and, in this embodiment, the carrier advantageously is the function strip itself. In this manner, the alarm tripping device is almost absolutely protected against detection and removal by unauthorized persons.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 1 is a schematic illustration of an alarm tripping device integrated in a function strip, wherein the function strip is sewn to a material portion of a textile product;

FIG. 2 is a sectional view taken along sectional line II—II of FIG. 1, showing a first embodiment of the invention;

FIG. 3 is a sectional view taken along sectional line II—II of FIG. 1, showing the embodiment of FIG. 2 with indications for inserting and removing the alarm tripping device;

FIG. 4 is a sectional view taken along sectional line II—II of FIG. 1, showing another embodiment;

FIG. 5 is a sectional view taken along sectional line II—II in FIG. 1, showing the embodiment of FIG. 4 with a directional arrow for removing the alarm tripping device;

FIG. 6 is a schematic illustration of another embodiment of the alarm tripping device;

FIG. 7 is a sectional view taken along sectional line VII—VII of FIG. 6;

FIG. 8 is a schematic illustration of another embodiment of an alarm tripping device; and FIG. 9 is a schematic illustration of a detail of an embodiment of an alarm tripping device with a woven-in thread-like alarm tripping component.

DESCRIPTION OF THE PREFERRED EMBODIMENTS

As illustrated in FIG. 1, an alarm tripping device 10 according to the invention is mounted in a function strip 11. The alarm tripping device 10 is composed of a thread-like alarm tripping component 12, an electronic component 13, i.e., a capacitor with a contact lug 14, and a carrier 19. The function strip 11 is constructed as a label which on an upper layer 23 is provided with writing 15 on a side facing away from the product. Such a writing 15 may serve to indicate the type of product, size or the like. The function strip 11 is secured at both short outer edges 16 where the function strip 11 is folded in toward the product and is sewn along two seams 17 to a material portion 18 of a product.

FIG. 2 shows the manner in which in this embodiment the alarm tripping device is placed in a pocket 22 which is provided between the upper layer 23 and the layer 24 of the function strip 11 facing the product. As indicated in FIG. 3, in this embodiment the function strip 11 is inserted in the direction of arrow 20; or, in an embodiment not shown in the drawing, the alarm tripping device 10 is attached to the function strip 11 in a prior production step, for example, by stitching the carrier 19 to one of the two layers 23, 24. The pocket 22 is closed by forcing the layer 24 of the function strip 11 facing the product past a short loop 25 of the upper layer 23 into the hollow space of the pocket 22, so that subsequently the layer 24 is prevented from slipping out by the protruding loop 25.

As a result, the product which has been provided with a transponder as the alarm tripping device in this manner is now secured and, when moved past a detector, will trigger an alarm. If the alarm is not to be triggered, the alarm tripping device 10 must again be removed from the function strip 11 in the direction of arrow 21 after the layer 24 of the function strip 11 facing the product has previously been pulled past the loop 25 for opening the pocket 22.

In a modification of the embodiment shown in FIG. 1, the carrier 19 of the alarm tripping device 10 corresponds to a layer 23, 24 of the function strip 11 as shown in FIGS. 4 and 5. In this case, the components 12, 13 of the alarm tripping device 10 are secured directly on a layer 23, 24 of the function strip 11. In this embodiment, the alarm tripping device 10 can be removed by merely pulling it out in the direction of arrow 21 after the alarm tripping device 10 has been separated from the function strip 11 at intended tearing points 26.

In the two embodiments shown in FIGS. 6–8, the alarm tripping device is shown as a transponder. In these alarm tripping devices 10, the thread-shaped alarm tripping component 12 is stitched in the form of a coil onto the carrier 19 and is electrically conductively connected to the electronic component 13, i.e., a capacitor, to form an electronic oscillation circuit. In both embodiments shown in FIGS. 6–8, the carrier 19 is composed of a woven material whose structure is indicated in FIGS. 6 and 7. In this embodiment, the thread-shaped alarm tripping component 12 is passed through the fabric of the carrier 19 at the stitching points 27, so that the thread-shaped alarm tripping component 12 extends over longer portions 28 at the upper side 13 of the carrier and over relatively shorter portions 29 along the bottom side 32 of the carrier 19. The ends 30 of the thread-shaped alarm tripping component 12 are arranged so as to float and are electrically conductively connected to the electronic components 13 of alarm tripping device 10, which, in the two embodiments illustrated in FIGS. 6–8, are mounted on the upper side 31 of the carrier 19. The alarm tripping device 10 is mounted, for example, on or in the function strip 11 in accordance with the solutions shown in FIGS. 2–5.

Another embodiment of an alarm tripping device 10 according to the present invention is shown in FIG. 9. In that case, the thread-shaped alarm tripping component 12 is a magnetizable thread which is woven as a warp thread 32 in a fabric 34. It is understood that the thread-shaped alarm tripping component 12 can also be introduced into the fabric 34 in the direction of the weft thread 35. The fabric 34 shown in FIG. 9 may be one of the layers 23, 24 of the function strip 11, or the fabric 34 may be a carrier 19 which is placed in the function strip 11. In contrast to the above-described alarm tripping devices 10 in the form of a transponder in which the alarm tripping device 10 must be removed from the product to inactivate the alarm, it is possible in the case of the use of the magnetizable thread-shaped alarm tripping component 12 to deactivate the alarm by demagnetizing the alarm tripping device 10. Accordingly, after demagnetizing the alarm tripping device 10, the product can be removed and carried out of the protected area by a consumer without triggering an alarm.

Finally, it shall be mentioned once again at this point that the above-described embodiments are examples and that the invention is not limited to these example. In particular, the materials of the carrier 19 and of the function strip 11 are freely selectable and the function strip 11 and/or the carrier 19 may be of leather, plastic foil or non-woven fabric, to mention just a few possibilities. Also, the type of products in connection with which the invention can be used may vary and is not limited to the types of products expressly mentioned above.

While specific embodiments of the invention have been shown and described in detail to illustrate the inventive principles, it will be understood that the invention may be embodied otherwise without departing from such principles.

I claim:

1. A theft protection system, particularly for textiles, leather goods and other products, comprising an alarm tripping device mounted on a function strip attached to the product, further comprising at least one detector in an exit area of a space to be protected, wherein the detector is configured to respond when a product provided with the alarm tripping device is moved past the detector, the alarm tripping device comprising at least one linear alarm tripping component mounted on a carrier, wherein the linear alarm tripping component of the alarm tripping device is a thread-like alarm tripping component connected to the carrier by a textile manufacturing method comprising one of stitching the thread-like alarm tripping component onto the carrier, sewing the thread-like alarm tripping component into the carrier, weaving the thread-like alarm tripping component into the carrier and working the thread-like alarm tripping component into the carrier by a crochet galloon method.

2. The theft protection system according to claim 1, wherein the function strip comprises at least two layers.

3. The theft protection system according to claim 2, wherein the two layers of the function strip form a pocket therebetween.

4. The theft protection system according to claim 2, wherein the carrier is identical with one of the layers of the function strip.

5. The theft protection system according to claim 1, wherein the carrier is manufactured by a textile manufacturing method for making one of a woven material, a knitted material and a non-woven fabric material and the thread-like alarm tripping component is connected to the carrier as the carrier is manufactured by the textile manufacturing method.

6. The theft protection system according to claim 1, wherein the carrier comprises a foil.

7. The theft protection system according to claim 1, wherein the thread-like alarm tripping component is comprised of an electrically conductive metal.

8. The theft protection system according to claim 1, wherein the thread-like alarm tripping component is comprised of a metallized foil strip.

9. The theft protection system according to claim 1, wherein the thread-like alarm tripping component is magnetic.

10. The theft protection system according to claim 1, wherein the thread-like alarm tripping component is magnetizable.

11. The theft protection system according to claim 1, wherein the thread-like alarm tripping component has exposed free ends, wherein the exposed free ends are electrically conductively connected to other electronic components of the alarm tripping device.

12. The theft protection system according to claim 1, wherein the alarm tripping device has additional electronic components provided with contact lugs, wherein the contact lugs are contactable with the thread-like alarm tripping component by moving the contact lugs toward the thread-like alarm tripping component.

* * * * *